US006655195B2

(12) United States Patent
Grabscheid et al.

(10) Patent No.: US 6,655,195 B2
(45) Date of Patent: Dec. 2, 2003

(54) MOISTURE CROSS PROFILE

(75) Inventors: Joachim Grabscheid, Gerstetten (DE); Ulrich Begemann, Heidenheim (DE); Oswald Satzger, Giengen (DE); Wolfgang Mayer, Heidenheim (DE); Ralf Rziha, Gerstetten (DE); Wolfgang Bamberger, Heidenheim (DE); Georg Kleiser, Heidenheim (DE); Thomas Rühl, Wernau (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/032,012

(22) Filed: Dec. 31, 2001

(65) Prior Publication Data

US 2002/0112532 A1 Aug. 22, 2002

(30) Foreign Application Priority Data

Feb. 22, 2001 (DE) ..... 101 08 517

(51) Int. Cl.[7] ..... D21F 7/00; G01N 5/04
(52) U.S. Cl. ..... 73/73; 162/198; 162/192
(58) Field of Search ..... 73/73; 156/64; 162/190, 198, 276; 34/335

(56) References Cited

U.S. PATENT DOCUMENTS

| | | | | | |
|---|---|---|---|---|---|
| 3,296,710 | A | * | 1/1967 | Krikorian | 34/95 |
| 3,574,261 | A | * | 4/1971 | Bailey | 34/465 |
| 3,973,329 | A | * | 8/1976 | Feess | 34/335 |
| 5,049,216 | A | * | 9/1991 | Shead et al. | 156/64 |
| 5,500,092 | A | * | 3/1996 | Schiel | 162/358.3 |
| 5,851,358 | A | * | 12/1998 | Kade | 162/276 |
| 5,879,513 | A | * | 3/1999 | Karvinen | 162/198 |
| 6,148,538 | A | * | 11/2000 | Steiner et al. | 34/114 |
| 2001/0010259 | A1 | * | 8/2001 | Steiner et al. | 162/190 |

FOREIGN PATENT DOCUMENTS

| | | | | |
|---|---|---|---|---|
| DE | 355958 | * | 7/1922 | |
| DE | 1070490 | * | 2/1956 | |
| DE | 19630190 A1 | * | 1/1998 | D21F/3/02 |
| DE | 20000599 U1 | * | 5/2000 | D21F/3/00 |
| DE | 19934875 | | 1/2001 | |
| DE | 10055708 A1 | * | 5/2002 | D21F/3/00 |

* cited by examiner

*Primary Examiner*—Hezron Williams
*Assistant Examiner*—David Rogers
(74) *Attorney, Agent, or Firm*—Greenblum & Bernstein, P.L.C.

(57) ABSTRACT

Process for determining disturbances of a moisture cross profile of a fibrous material web in a paper making machine, a paper making machine, and a measuring arrangement for measuring the disturbances, the process including guiding the fibrous material web by way of at least one water-permeable belt and collecting and draining off water released from the belt. The water is collected by several sections separated from one another. The process further includes measuring per time unit, the amount of water in each section, wherein the sections extend at right angles to a web running direction over only a partial section of the fibrous material web. The paper making machine includes at least one water-permeable belt, the belt being wrapped around a roll. The measuring arrangement includes a water collection device having the form of one of a trough or channel.

28 Claims, 3 Drawing Sheets

MOISTURE CROSS PROFILE

CROSS-REFERENCE TO RELATED APPLICATIONS

The present application claims priority under 35 U.S.C. §119 of German Patent Application No. 101 08 517.6, filed on Feb. 22, 2001, the disclosure of which is expressly incorporated by reference herein in its entirety.

BACKGROUND OF THE INVENTION

1. Field of the Invention

The invention relates to a process and corresponding measuring arrangements for determining disturbances of the moisture cross profile of a paper, cardboard, tissue, or any other fibrous material web in machines for producing the same, with the fibrous material web being guided by at least one water permeable belt and with the water released from the belt being collected and drained off.

2. Discussion of Background Information

It is generally desired to produce fibrous webs having a moisture cross profile as even as possible, because an even moisture distribution provides a basis for web characteristics being as constant as possible over the surface, such as printability, cockling, gloss, and the like.

However, since the production process is almost always accompanied by irregularities with respect to the moisture cross profile, the fibrous material web is dampened and dewatered in the respective zones. However, a good moisture cross profile correction also requires the knowledge about the current moisture cross profile of the fibrous material web to be as exact as possible.

For this purpose, inductively operating measuring units have been developed, for example. However, they are expensive and not sufficiently accurate, in particular, when the fibrous material web is guided between two belts.

SUMMARY OF THE INVENTION

Thus, the invention is to create a way to determine disturbances of the moisture cross profile of a fibrous material web that is as simple as possible and relatively exact.

The invention was attained by a process in which the water is collected by several sections, separated from one another, and the amount of water collected in each section per time unit is measured, with the sections each extending at right angles to the web running direction only over a partial section of the fibrous material web.

With this indirect measurement, conclusions can be drawn from the collected water quantity per time unit about the moisture content in the corresponding partial section of the fibrous material web, and conclusions about the moisture cross profile of the fibrous material web can be drawn from a comparison between the sections.

In order to avoid falsification of the measuring values, the sections should each be allocated to partial sections of the fibrous material web separated from one another. Additionally, in order to achieve a comprehensive impression, the sections should also cover the entire width of the fibrous material web. Here, the sections can be staggered in the web running direction or arranged adjacent to one another.

To achieve the desired moisture cross profile, the measurement results of the amounts of water collected from the sections should be fed to a control or adjustment unit controlling at least one moisture cross profile correction unit. For the design of a control circuit, the moisture cross profile correction unit should be arranged sufficiently prior to the determination of the moisture cross profile.

This process is particularly suitable in cases in which the fibrous material web is guided on each sides by a belt, and both belts are preferably embodied water-permeably: Here, it is advantageous for the water released from the two belts to be collected and measured in sections.

To implement the measuring process according to the invention, there are several possible measuring arrangements that can also be used in a machine for producing a fibrous material web at the same time.

Particularly when the belt together with the outside fibrous material web partially wraps around a roll, such as a press or guiding roll, it is possible to assign to the roll a water collection device in the shape of a trough, channel or the like, running at right angles to the web running direction with several partitions dividing the water collection device into sections arranged next to each other at right angles to the web running direction where the water amount drained from the sections is determined per time unit by a measuring unit.

Apart from wrapping around a roll, however, when the fibrous material web together with a belt is fed through a nip formed by two press rolls, to realize the process it is possible to assign to the press roll coming into contact with the belt a water collection device in the shape of a trough, channel or the like, running at right angles to the web running direction with several partitions dividing the water collection device into sections arranged next to each other at right angles to the web running direction, where the water amount drained from the sections is also determined per time unit by a measuring unit.

If the fibrous material web travels through the press nip together with a water-permeable belt on each side, one sectioned water collection device should preferably be allocated to each of the two press rolls.

Another embodiment of the process results from guiding the belt over a suction device running at right angles to the web running direction. Here, it is characteristic for the suction device embodied as a pipe suction device, a suction box, or the like to be provided with several partitions dividing the suction device into sections arranged next to one another at right angles to the web running direction, with the amount of water drained from the sections per time unit being determined by a measuring unit. If the fibrous material web is guided on each side by a water-permeable belt, a sectioned suction device should be allocated to both belts as well.

Flowmeters are particularly suitable measuring units. To control the moisture cross profile of the fibrous material web, the measuring units should be connected to a control or adjustment unit for at least one moisture cross profile correction unit.

Known types of spraying pipes or spray tubes to dampen, or suction devices to drain, controllable particularly in zones at cross angles to the web running direction, are suitable as moisture cross profile correction units. Zonally controllable conditioning devices of the belts, particularly of the press felt, can be used for moisture cross profile corrections as well.

The measuring process and/or the corresponding measuring devices can be used advantageously in the former of a paper machine for forming sheets and/or in the press section of a machine for dewatering a fibrous material web. Here, the water-permeable belts are usually embodied in the former as former wires and in the press section as press felts.

According to an aspect of the invention, the disturbances of a moisture cross profile of a fibrous material web in a machine for making the fibrous material web, are determined by guiding the fibrous material web by way of at least one water-permeable belt, collecting and draining off water released from the belt, wherein the water is collected by several sections separated from one another and measuring per time unit, the amount of water in each section, wherein the sections extend at right angles to a web running direction over only a partial section of the fibrous material web.

The fibrous material web may comprise one of paper, cardboard, or tissue. Each of the sections is separated from one another and allocated to partial sections of the fibrous material web. The sections may cover an entire width of the fibrous material web. Measurement results of the amounts of water collected by the sections may be fed to one of a control or adjustment unit influencing at least one moisture cross profile correction unit.

According to a further aspect of the invention, the fibrous material web is guided on each side by a belt, wherein both belts are water permeable. Water released from the two belts may be collected and measured by sections.

According to another aspect of the invention, a machine for making a fibrous material web includes a measuring arrangement for determining disturbances of a moisture cross profile of the fibrous material web, the machine comprising at least one water-permeable belt, the belt being wrapped around a roll. The measuring arrangement comprises a water collection device running at right angles to a web running direction, the water collection device having the form of one of a trough, or channel. A plurality of partitions divide the water collection device into sections, the partitions being positioned next to one another at right angles to the web running direction and being allocated to the roll. At least one measuring unit is provided for measuring the amount of water drained from the sections per time unit.

The at least one measuring unit may comprise a flowmeter. The machine may further comprise one of a control or adjustment unit for at least one moisture cross profile correction unit, the at least one measuring unit being connected to the one of a control or adjustment unit. The moisture cross profile correction unit comprises one of, a jet or spray pipe controllable in zones at right angles to the web running direction.

According to yet another aspect of the invention, a machine for making a fibrous material web includes a measuring arrangement for determining disturbances of a moisture cross profile of the fibrous material web, the machine comprising at least one water-permeable belt and two press rolls. At least one of the press rolls comes in contact with the belt. A press nip is formed by the two press rolls, the fibrous material web being guided together with the belt through the press nip. The measuring arrangement comprises a water collection device in the form of one of a trough or channel. A plurality of partitions divide the water collection device into sections arranged next to one another at right angles to a web running direction and are allocated to the at least one press roll that comes into contact with the belt. At least one measuring unit is provided for measuring the amount of water drained from the sections per time unit.

The at least one measuring unit may comprise a flowmeter. The machine may further comprise one of a control or adjustment unit for at least one moisture cross profile correction unit, the at least one measuring unit being connected to the one of a control or adjustment unit. The fibrous material web may travel through the press nip together with at least one water-permeable belt on each side and each sectioned water collection device being allocated to both press rolls. The moisture cross profile correction unit may comprise one of, a jet or spray pipe controllable in zones at right angles to the web running direction.

According to the invention, a machine for making a fibrous material web includes a measuring arrangement for determining disturbances of a moisture cross profile of the fibrous material web, the machine comprising at least one water-permeable permeable belt and a suction device running at right angles to a web running direction, wherein the suction device comprises one of a pipe suction device, or a suction box. The belt is guided over the suction device running at right angles to a web running direction. The measuring arrangement comprises a water collection device running at right angles to a web running direction, the water collection device having the form of one of a trough, or channel. A plurality of partitions divide the suction device into sections, the partitions being positioned next to one another at right angles to the web running direction and being allocated to the roll. A measuring unit is provided for measuring the amount of water drained from the sections per time unit.

The at least one measuring unit may comprise a flowmeter. The fibrous material web may be guided by one water-permeable belt on each side and a sectioned suction device is allocated to both belts. One of a control or adjustment unit may be provided for at least one moisture cross profile correction unit, the at least one measuring unit being connected to the one of a control or adjustment unit. The moisture cross profile correction unit may comprise a suction device for dewatering.

According to another aspect of the invention, a paper making machine comprises a former for sheet formation and a water-permeable belt embodied as a former wire for guiding the sheet. A water collection device has several sections separated from one another for collecting and draining off water released from the belt. A measuring arrangement is provided for determining disturbances of a moisture cross profile of the sheet by measuring per time unit, the amount of water in each section, wherein the sections extend at right angles to a sheet running direction over only a partial section of the sheet.

Further, according to the invention, a paper making machine comprises a press section for dewatering and a water-permeable belt embodied as a press felt. A water collection device has several sections separated from one another for collecting and draining off water released from the belt. A measuring arrangement is provided for determining disturbances of a moisture cross profile of the belt by measuring per time unit, the amount of water in each section, wherein the sections extend at right angles to a belt running direction over only a partial section of the belt.

Moreover, according to the invention, a measuring arrangement is provided for determining disturbances of a moisture cross profile of a fibrous material web made in a machine for making the web, wherein the machine includes at least one water-permeable belt wrapped around a roll. The measuring arrangement comprises a water collection device running at right angles to a web running direction, the water collection device having the form of one of a trough, or channel. A plurality of partitions divide the water collection device into sections, the partitions being positioned next to one another at right angles to a web running direction and being allocated to a roll. At least one measuring unit is provided for measuring the amount of water drained from the sections per time unit.

According to the invention, a measuring arrangement is provided for determining disturbances of a moisture cross profile of a fibrous material web made in a machine for making the web, wherein the machine includes at least one water-permeable belt and two press rolls, at least one of the press rolls coming in contact with the belt, and a press nip being formed by the two press rolls. The fibrous material web is guided together with the belt through the press nip. The measuring arrangement comprises a water collection device having the form of one of a trough, or channel. A plurality of partitions divide the water collection device into sections arranged next to one another at right angles to a web running direction and are allocated to the at least one press roll that comes into contact with the belt. At least one measuring unit is provided for measuring the amount of water drained from the sections per time unit.

The fibrous material web travels through the press nip together with at least one water-permeable belt on each side and each sectioned water collection device is allocated to both press rolls.

Further, according to the invention, a machine for making a fibrous material web includes a measuring arrangement for determining disturbances of a moisture cross profile of the fibrous material web, the machine comprising at least one water-permeable belt, the belt being wrapped around a roll. The measuring arrangement comprises a water collection device running at right angles to a web running direction, the water collection device having the form of one of a trough, or channel. A plurality of partitions divide the water collection device into sections, the partitions being positioned next to one another at right angles to the web running direction and being allocated to the roll. At least one measuring unit is provided for measuring the amount of water drained from the sections per time unit. One of a control or adjustment unit is provided for at least one moisture cross profile correction unit, the at least one measuring unit being connected to the one of a control or adjustment unit, wherein the moisture cross profile correction unit comprises one of, a jet or spray pipe controllable in zones at right angles to the web running direction for wetting, or a suction device for dewatering.

Moreover, according to the invention, a machine for making a fibrous material web includes a measuring arrangement for determining disturbances of a moisture cross profile of the fibrous material web, the machine comprising at least one water-permeable belt, two press rolls, at least one of the press rolls coming in contact with the belt and a press nip formed by the two press rolls, the fibrous material web being guided together with the belt through the press nip. The measuring arrangement comprises a water collection device running at right angles to a web running direction, the water collection device having the form of one of a trough, or channel. A plurality of partitions divide the water collection device into sections, the partitions being positioned next to one another at right angles to the web running direction and being allocated to the roll. At least one measuring unit is provided for measuring the amount of water drained from the sections per time unit. One of a control or adjustment unit is provided for at least one moisture cross profile correction unit, the at least one measuring unit being connected to the one of a control or adjustment unit, wherein the moisture cross profile correction unit comprises one of, a jet or spray pipe controllable in zones at right angles to the web running direction for wetting, or a suction device for dewatering.

In the following, the invention is explained in greater detail using several exemplary embodiments.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
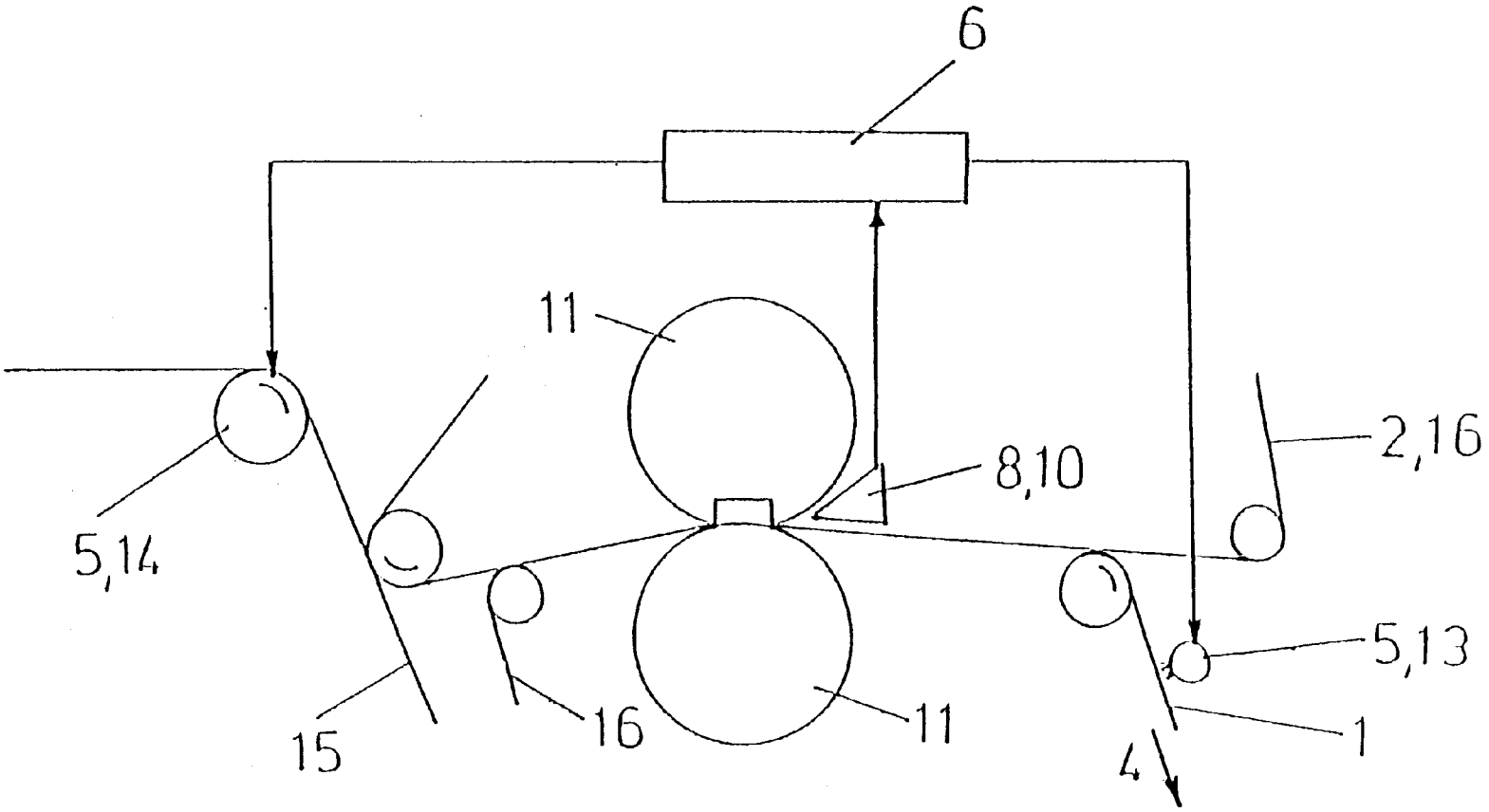
FIG. 1 a schematic cross section of a part of the former and the press section of a paper machine, FIG. 2 a press nip with a measuring arrangement, FIG. 3 a web deflection with a measuring arrangement, and FIG. 4 a suction device 12 with a measuring arrangement.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In all embodiments the fibrous material web 1 is guided on each side by a water-permeable belt 2 in the measuring range, which makes the determination of the moisture cross profile of the fibrous material web 1 very difficult using conventional means.

To directly determine disturbances of the moisture cross profile of the fibrous material web 1, according to the general measuring method, the water released from belt 2 is collected and drained. According to the invention, this occurs such that the water is collected in several sections 3 separated from one another and arranged adjacently at right angles to the web running direction 4, and, thus, the amount of water collected per section 3 per time unit is measured.

As the sections 3 do not overlap and extend over the entire width of the fibrous material web 1, the evaluation of the amounts of water drained from the sections 3 result in a relatively exact representation of the current moisture cross profile of the fibrous material web 1.

FIG. 1 shows a possible measuring arrangement for this purpose, in which the fibrous material web 1 together with a water absorbing press felt 16 on each side being guided through a press nip formed by two press rolls 11.

Here, the determination of the amount of water released from a belt 2 in the form of the upper press felt 16 is shown in an exemplary manner. This occurs by way of a water collection device 8 in the form of a channel that is allocated to the upper press roll 11 at the outlet of the press nip. Here, the water collection device 8 collects the water released from the belt 2 to the upper press roll 11 and spun off from there.

Figure 2:
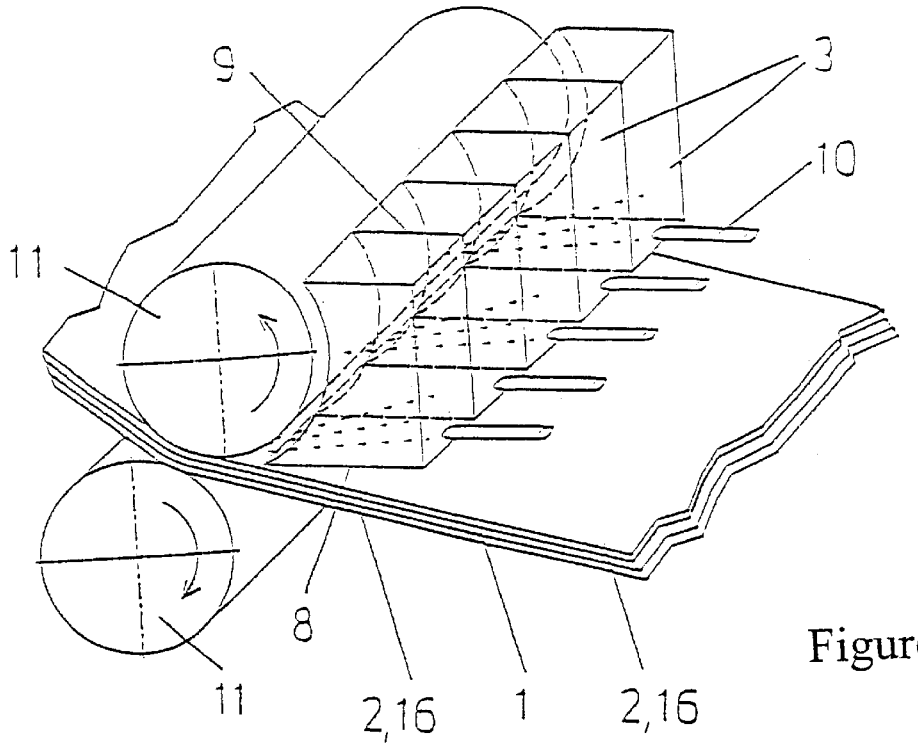

For this purpose, according to FIG. 2, the water collection device 8 is divided by partitions 9 into several sections 3 arranged next to one another. Furthermore, the amount of water drained from each section 3 is determined by a measuring unit 10 in the form of a flowmeter.

A large water yield in a section 3 indicates a low moisture content in the corresponding partial section of the fibrous material web 1 and vice versa. This results from the assumption that the fibrous material web 1 has an even moisture cross profile at the start of the paper machine.

The measurement results regarding the amounts of water collected from the sections 3 are transmitted to the control and adjustment unit 6. From there, the moisture cross profile can be controlled by way of moisture cross profile correction units 5.

After the press nip the upper press felt 16 is guided off and the fibrous material web 1 only is further guided at the lower press felt 16.

A moisture cross profile correction unit 5 in the form of a spray pipe 13 for water vapor, controllable in zones at right angles to the web running direction 4, is positioned opposite the side of the fibrous material web 1 facing the lower press felt 16. This spray pipe 13 is influenced by the control and adjustment unit 6 and serves to dampen the partial sections of the fibrous material web 1 that are too dry.

A moisture cross profile correction unit 5 in the form of a suction unit 14, particularly of a suctioned roll wrapped by the former wire 15, is likewise located in the former positioned upstream of the press nip of the press section. Here, the suctioned roll is divided into several zones positioned next to one another at right angles to the web running direction 4, having a vacuum that can be controlled separately. This allows the zonal control of dewatering the fibrous material web 1 through the former wire 15.

The coupling to the control and adjustment unit 6 allows this suction unit 14 to develop a control circuit in such a way that the moist partial sections of the fibrous material web 1 are suctioned more strongly than the others.

Subsequently, the former wire 15 transfers the fibrous material web 1 to the upper press felt 16 of the press nip.

Figure 3:
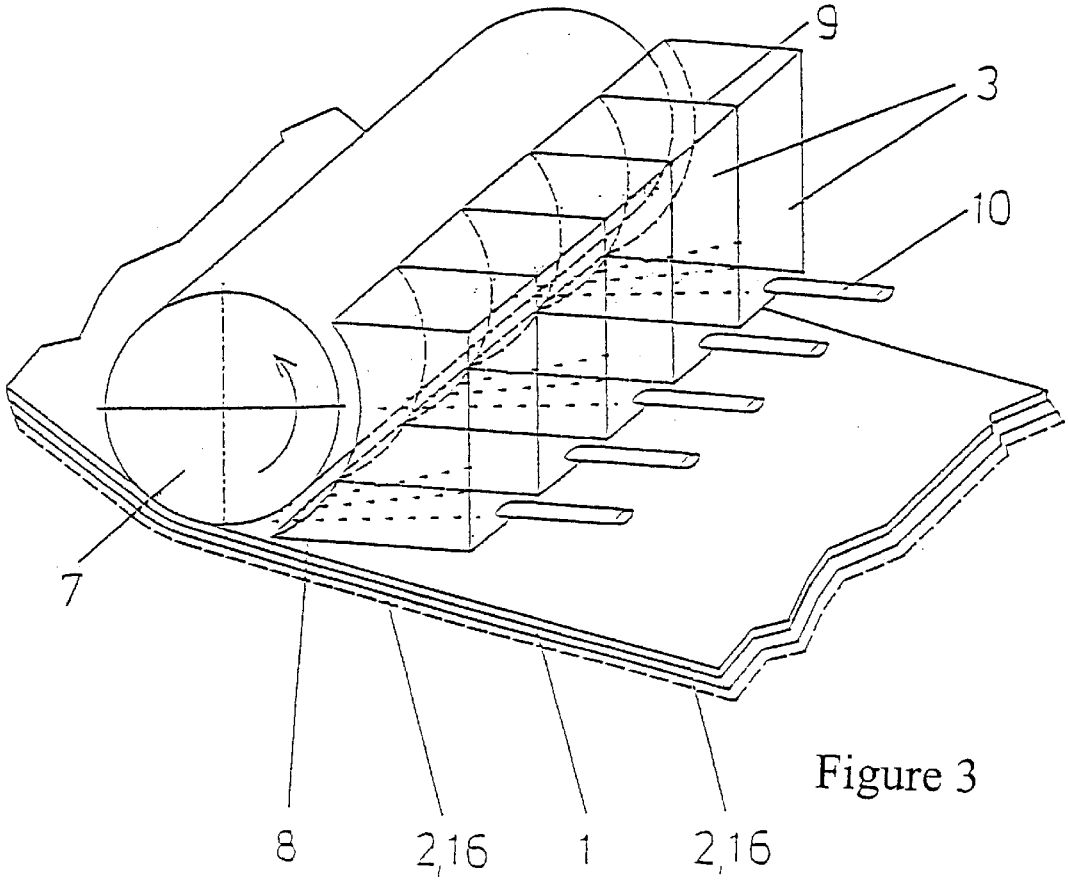

FIG. 3 shows the common deflection of the fibrous material web 1 with a water-permeable belt 2 in the form of a press felt 16 on each side. Here, the water absorbed by the wrapped roll 7 and then spun off again is collected by a sectioned water collection device 8. Here the measurement of the amounts of water collected from the sections 3 also occurs.

Figure 4:
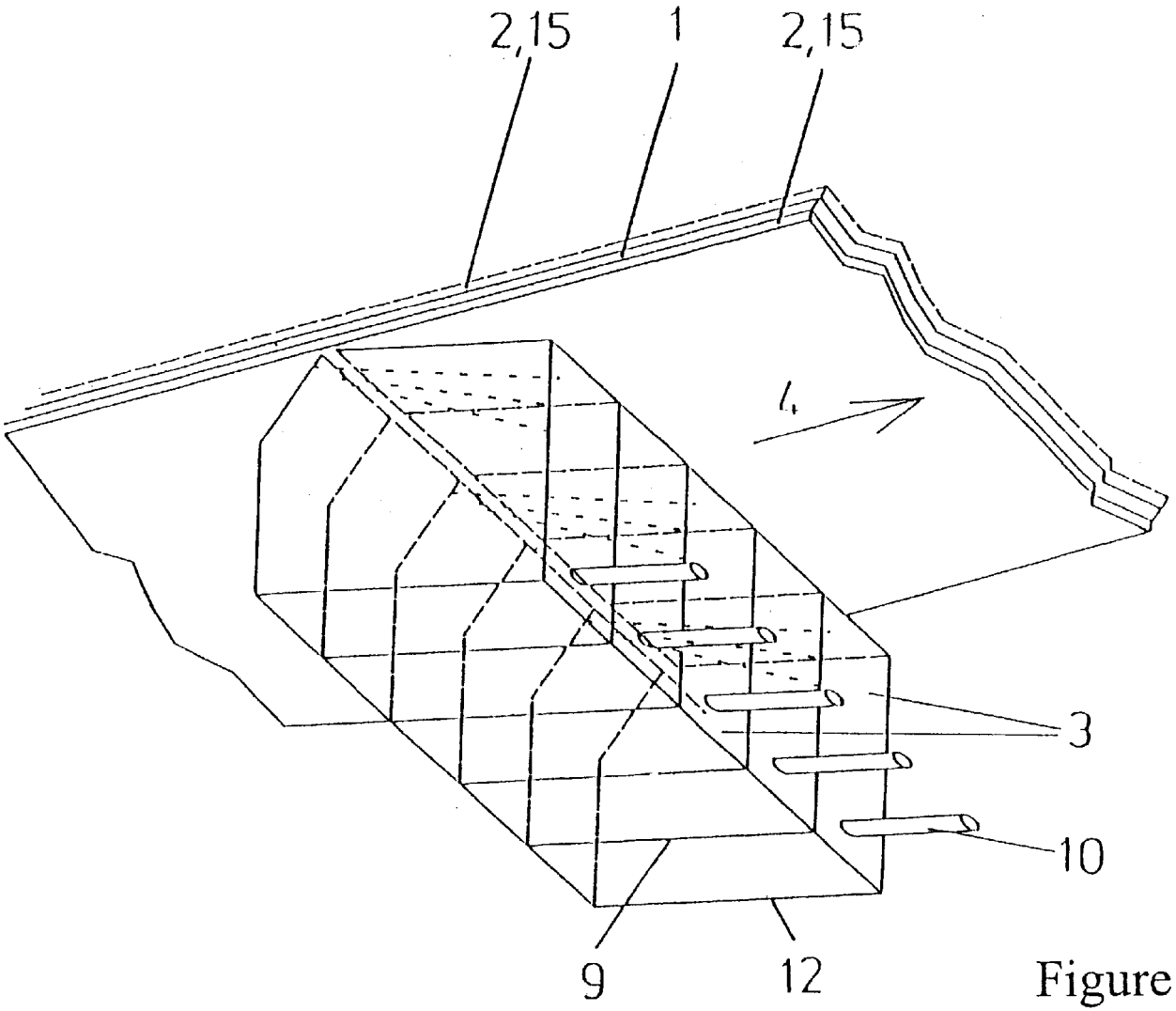

FIG. 4 shows a measuring arrangement in a former with the fibrous material web 1 being guided on each side by a water-permeable belt 2 a in the form of a former wire 15. As an example, a belt 2 is guided past a suction device 12 sectioned by partitions 9. The vacuum existing in the sections 3 causes a dewatering of the fibrous material web 1 through the corresponding belt 2. This means that a large water yield in a section 3 indicates a lower moisture content in the corresponding partial section of the fibrous material web 1. Of course, this presupposes an almost identical vacuum in the sections 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. Process for determining disturbances of a moisture cross profile of a fibrous material web in a machine for making said fibrous material web, the process comprising:

guiding the fibrous material web by way of at least one water-permeable belt;

collecting and draining off water released from the at least one water-permeable belt, wherein the water is collected by several sections separated from one another; and measuring per time unit, the amount of water in each section to determine the moisture cross profile of the fibrous material web, wherein said sections extend at right angles to a web running direction and each section extends over only a partial section of the fibrous material web.

2. The process according to claim 1, wherein the fibrous material web comprises one of paper, cardboard, or tissue.

3. The process according to claim 1, wherein each of said sections is separated from one another and allocated to partial sections of the fibrous material web.

4. The process according to claim 1, wherein the sections cover an entire width of the fibrous material web.

5. The process according to claim 1, further comprising feeding the measurement results of the amounts of water collected by the sections to one of a control or adjustment unit influencing at least one moisture cross profile correction unit.

6. The process according to claim 1, further comprising guiding the fibrous material web on each side by a belt, wherein both belts are water permeable.

7. The process according to claim 6, further comprising collecting and measuring by sections water released from the two belts.

8. A machine for making a fibrous material web including a measuring arrangement for determining disturbances of a moisture cross profile of the fibrous material web, said machine comprising:

at least one water-permeable belt;

said belt being wrapped around a roll;

said measuring arrangement comprising:

a water collection device running at right angles to a web running direction, said water collection device having the form of one of a trough, or channel;

a plurality of partitions dividing the water collection device into sections, said partitions being positioned next to one another at right angles to the web running direction and being allocated to the roll; and at least one measuring unit for measuring the amount of water drained from the sections per time unit.

9. The machine according to claim 8, wherein the at least one measuring unit comprises a flowmeter.

10. The machine according to claim 8, further comprising one of a control or adjustment unit for at least one moisture cross profile correction unit, the at least one measuring unit being connected to said one of a control or adjustment unit.

11. The machine according to claim 10, wherein the moisture cross profile correction unit comprises one of, a jet or spray pipe controllable in zones at right angles to the web running direction.

12. A machine for making a fibrous material web including a measuring arrangement for determining disturbances of a moisture cross profile of the fibrous material web, said machine comprising:

at least one water-permeable belt;

two press rolls, at least one of the press rolls coming in contact with the belt;

a press nip formed by said two press rolls, said fibrous material web being guided together with the belt through said press nip;

said measuring arrangement comprising:

a water collection device in the form of one of a trough or channel;

a plurality of partitions dividing the water collection device into sections arranged next to one another at right angles to a web running direction and being allocated to the at least one press roll that comes into contact with the belt; and at least one measuring unit for measuring the amount of water drained from the sections per time unit.

13. The machine according to claim 12, wherein the at least one measuring unit comprises a flowmeter.

14. The machine according to claim 12, further comprising one of a control or adjustment unit for at least one moisture cross profile correction unit, the at least one measuring unit being connected to said one of a control or adjustment unit.

15. The machine according to claim 12, wherein the fibrous material web travels through said press nip together with at least one water-permeable belt on each side and each sectioned water collection device being allocated to both press rolls.

16. The machine according to claim 12, wherein the moisture cross profile correction unit comprises one of, a jet or spray pipe controllable in zones at right angles to the web running direction.

17. A machine for making a fibrous material web including a measuring arrangement for determining disturbances of a moisture cross profile of the fibrous material web, said machine comprising:

at least one water-permeable belt;

a suction device running at right angles to a web running direction, wherein the suction device comprises one of a pipe suction device, or a suction box;

said belt being guided over said suction device running at right angles to a web running direction;

said measuring arrangement comprising:

a water collection device running at right angles to a web running direction, said water collection device having the form of one of a trough, or channel;

a plurality of partitions dividing the suction device into sections, said partitions being positioned next to one another at right angles to the web running direction and being allocated to the roll; and a measuring unit for measuring the amount of water drained from the sections per time unit.

18. The machine according to claim 17, wherein the at least one measuring unit comprises a flowmeter.

19. The machine according to claim 17, wherein the fibrous material web is guided by one water-permeable belt on each side and a sectioned suction device is allocated to both belts.

20. The machine according to claim 17, further comprising one of a control or adjustment unit for at least one moisture cross profile correction unit, the at least one measuring unit being connected to said one of a control or adjustment unit.

21. The machine according to claim 20, wherein the moisture cross profile correction unit comprises a suction device for dewatering.

22. A paper making machine comprising:

a former for sheet formation;

a water-permeable belt embodied as a former wire for guiding the sheet;

a water collection device having several sections separated from one another for collecting and draining off water released from the belt; and a measuring arrangement for determining disturbances of a moisture cross profile of the sheet by measuring per time unit, the amount of water in each section, wherein said sections extend at right angles to a sheet running direction over only a partial section of the sheet.

23. A paper making machine comprising:

a press section for dewatering;

a water-permeable belt embodied as a press felt;

a water collection device having several sections separated from one another for collecting and draining off water released from the belt; and a measuring arrangement for determining disturbances of a moisture cross profile of the belt by measuring per time unit, the amount of water in each section, wherein said sections extend at right angles to a belt running direction over only a partial section of the belt.

24. A measuring arrangement for determining disturbances of a moisture cross profile of a fibrous material web made in a machine for making the web, wherein the machine includes at least one water-permeable belt wrapped around a roll, said measuring arrangement comprising:

a water collection device running at right angles to a web running direction, said water collection device having the form of one of a trough, or channel;

a plurality of partitions dividing the water collection device into sections, said partitions being positioned next to one another at right angles to a web running direction and being allocated to a roll; and at least one measuring unit for measuring the amount of water drained from the sections per time unit.

25. A measuring arrangement for determining disturbances of a moisture cross profile of a fibrous material web made in a machine for making the web, wherein the machine includes at least one water-permeable belt and two press rolls, at least one of the press rolls coming in contact with the belt, a press nip formed by said two press rolls, said fibrous material web being guided together with the belt through said press nip, said measuring arrangement comprising:

a water collection device having the form of one of a trough, or channel;

a plurality of partitions dividing the water collection device into sections arranged next to one another at right angles to a web running direction and being allocated to the at least one press roll that comes into contact with the belt; and at least one measuring unit for measuring the amount of water drained from the sections per time unit.

26. The measuring arrangement according to claim 25, wherein the fibrous material web travels through said press nip together with at least one water-permeable belt on each side and each sectioned water collection device being allocated to both press rolls.

27. A machine for making a fibrous material web including a measuring arrangement for determining disturbances of a moisture cross profile of the fibrous material web, said machine comprising:

at least one water-permeable belt;

said belt being wrapped around a roll;

said measuring arrangement comprising:

a water collection device running at right angles to a web running direction, said water collection device having the form of one of a trough, or channel;

a plurality of partitions dividing the water collection device into sections, said partitions being positioned next to one another at right angles to the web running direction and being allocated to the roll;

at least one measuring unit for measuring the amount of water drained from the sections per time unit;

one of a control or adjustment unit for at least one moisture cross profile correction unit, the at least one measuring unit being connected to said one of a control or adjustment unit, wherein the moisture cross profile correction unit comprises one of, a jet or spray pipe controllable in zones at right angles to the web running direction for wetting, or a suction device for dewatering.

28. A machine for making a fibrous material web including a measuring arrangement for determining disturbances of a moisture cross profile of the fibrous material web, said machine comprising:

at least one water-permeable belt;

two press rolls, at least one of the press rolls coming in contact with the belt;

a press nip formed by said two press rolls, said fibrous material web being guided together with the belt through said press nip;

said measuring arrangement comprising:

a water collection device running at right angles to a web running direction, said water collection device having the form of one of a trough, or channel;

a plurality of partitions dividing the water collection device into sections, said partitions being positioned next to one another at right angles to the web running direction and being allocated to the roll;

at least one measuring unit for measuring the amount of water drained from the sections per time unit;

one of a control or adjustment unit for at least one moisture cross profile correction unit, the at least one measuring unit being connected to said one of a control or adjustment unit, wherein the moisture cross profile correction unit comprises one of, a jet or spray pipe controllable in zones at right angles to the web running direction for wetting, or a suction device for dewatering.

* * * * *